US007791864B2

(12) United States Patent
Matyas et al.

(10) Patent No.: US 7,791,864 B2
(45) Date of Patent: Sep. 7, 2010

(54) ELECTRICAL POWER CONTROL OUTLET AND SYSTEM

(75) Inventors: Raymond T. Matyas, Las Vegas, NV (US); Dan Roman, Encino, CA (US); Sergio Corona, Upland, CA (US); Richard Heller, Las Vegas, NV (US)

(73) Assignee: Interface Group - Nevada, Inc., Las Vegas, NV (US)

( * ) Notice: Subject to any disclaimer, the term of this patent is extended or adjusted under 35 U.S.C. 154(b) by 254 days.

(21) Appl. No.: 12/027,446

(22) Filed: Feb. 7, 2008 (Under 37 CFR 1.47)

(65) Prior Publication Data

US 2008/0191831 A1 Aug. 14, 2008

Related U.S. Application Data

(60) Provisional application No. 60/900,499, filed on Feb. 9, 2007.

(51) Int. Cl.
*H01H 85/20* (2006.01)

(52) U.S. Cl. ..... 361/630; 361/622; 361/642; 337/4; 337/6; 337/11; 337/186; 337/187; 337/198

(58) Field of Classification Search ..... 337/4, 337/198, 6, 186, 187; 361/622, 630, 642
See application file for complete search history.

(56) References Cited

U.S. PATENT DOCUMENTS 1,863,824 A * 6/1932 Barnett ..... 337/198
1,955,076 A * 4/1934 Ludwig ..... 337/92
2,563,066 A * 8/1951 Procopio ..... 307/149
2,597,600 A * 5/1952 Shapiro ..... 439/651
2,636,096 A * 4/1953 Di Blasi ..... 337/189
2,649,522 A * 8/1953 Marcus ..... 337/197
2,783,329 A * 2/1957 Jackson ..... 337/91
3,012,090 A * 12/1961 Robbins ..... 174/53
3,076,077 A * 1/1963 Lindeman ..... 337/197
3,539,961 A * 11/1970 Worthington ..... 337/197
3,699,285 A * 10/1972 Leatherman ..... 200/51.09
3,846,598 A * 11/1974 Mucsi ..... 200/51.09
4,271,337 A * 6/1981 Barkas ..... 200/51.09
4,330,167 A * 5/1982 Chien-Tung ..... 439/620.3
4,484,185 A * 11/1984 Graves ..... 340/656
4,514,715 A * 4/1985 Chen ..... 337/113
4,538,134 A * 8/1985 Carey ..... 337/113
4,887,975 A * 12/1989 Jarred ..... 439/490
4,951,025 A * 8/1990 Finnegan et al. ..... 337/113
5,262,749 A * 11/1993 Kopelman ..... 337/103
5,320,563 A * 6/1994 Liao ..... 439/620.34
5,451,173 A * 9/1995 Mai ..... 439/620.29

(Continued)

FOREIGN PATENT DOCUMENTS

WO WO 9960670 A1 * 11/1999

*Primary Examiner*—Anatoly Vortman
(74) *Attorney, Agent, or Firm*—Finnegan. Henderson, Farabow, Garrett & Dunner, LLP

(57) ABSTRACT

Devices, systems and methods for regulating the distribution of electricity at events such as trade shows to prevent exhibitors from utilizing electricity not purchased from the convention center or other entity controlling electricity distribution, including lockable electric outlet boxes having a lockable fuse holder containing a fuse that restricts or limits a specific electrical outlet box or group of outlet boxes to a maximum electrical current or amperage.

11 Claims, 4 Drawing Sheets

U.S. PATENT DOCUMENTS 5,590,010 A * 12/1996 Ceola et al. ..... 361/93.4
5,742,464 A * 4/1998 Ceola et al. ..... 361/103
5,894,258 A * 4/1999 Chang ..... 337/255
5,930,097 A * 7/1999 Ceola et al. ..... 361/103
6,166,618 A * 12/2000 Robertson et al. ..... 337/380
6,204,747 B1 * 3/2001 Kitchens ..... 337/407
6,310,291 B1 * 10/2001 Clough ..... 174/67
6,340,926 B1 * 1/2002 Chu ..... 337/407
6,650,222 B2 * 11/2003 Darr et al. ..... 337/187
6,753,755 B2 * 6/2004 Montague ..... 337/265
7,162,378 B2 * 1/2007 Hynds et al. ..... 702/60
7,206,505 B2 * 4/2007 Gasper ..... 392/392
7,385,473 B2 * 6/2008 Fabian et al. ..... 337/36
7,489,227 B2 * 2/2009 Fabian et al. ..... 337/37
2004/0246638 A1 * 12/2004 Davies ..... 361/42
2006/0003619 A1 * 1/2006 Hynds et al. ..... 439/188

* cited by examiner

ELECTRICAL POWER CONTROL OUTLET AND SYSTEM

The present application claims priority on U.S. application 60/900,499, filed Feb. 9, 2007, entitled "Electrical Power Control Outlets, Methods of Use and Systems", which is incorporated by reference herein.

FIELD OF INVENTION

The present power control outlet, method of use and system relates generally to devices and systems for regulating the distribution of electricity at events such as trade shows to prevent exhibitors from utilizing electricity not purchased from the convention center or other entity controlling electricity distribution. Specifically, the invention relates to lockable electric outlet devices and systems that restrict or limit a specific electrical outlet or group of outlets to a maximum electrical current or amperage

BACKGROUND OF INVENTION

At trade shows, exhibitors typically purchase electrical power or are allotted a certain amount of electrical power from a convention center provider and the convention center provider typically supplies electrical power to the exhibitors via power strips supplied by a master power distribution system, which is in turn power powered by a public utility. The power strips typically contain individual electrical outlets, or groups of outlets that are placed behind exhibitors' booths. Typically the fee for rental of exhibition space includes a fee for a specified amount of electrical power. One problem in this regard has been use by exhibitors of more electrical power than was purchased by the exhibitor(s). Excess use of electrical power by one or more exhibitors then creates problems with the electrical distribution system itself, in addition to the problem of use of electrical power without payment to the provider. These electrical system problems include the potential for overloading the entire convention facility master power distribution system, as well as leaving some of the exhibitors with an insufficient supply of electrical power, depending of course on how the master power distribution system for the entire convention center is configured. There is currently no known device or system that attempts to solve this problem, and there is no known device for use in convention centers, or other facilities used for conventions, that limits the amount of electrical power that each individual outlet, group of outlets, power strip, or group of power strips is allocated from the master power distribution system.

SUMMARY OF THE INVENTION

It is an object of the invention to provide a device that regulates the quantity of electricity allotted to convention exhibitors at trade shows, and other special events. The device isolates a specific outlet to specific amperage of a shared or multiple circuits. If an individual outlet utilizes a greater quantity of electricity than the specific amperage that has been allotted, a fuse inside the distribution box will break, suspending electricity flow to that outlet. An indicator light on the outer surface of the distribution box will cease to emit light when a fuse breaks and electricity ceases to flow through the circuit.

The invention comprises a device that is connected to a master power distribution system that is commonly used to distribute electricity to exhibitors at trade shows and other special events and functions to limit the rate of current supplied from the device by having a lockable, fuse containing fuse holder in circuit whereby the fuse is blown or opened upon the exhibitor drawing power out of the outlet at a rate greater than permitted by the fused circuit.

The device includes a circuit box containing one or more fuses, a power cord, one or more receptacles, a light emitting diode (LED) for indicating power availability, or an energized system, a fuse holder, one or more fuses in the fuse holder, a locking mechanism that functions to prevent access to the fuse holder without the key for the lock, and wiring to and from the power cord to the receptacle(s) that forms an electrical circuit. The housing also has a recessed area adapted to accommodate a panel mount fuse holder which contains one or more fuses including, for example, a 5, 10, or 20 ampere current limiting, type G fuse. Also included is a locking bar type mechanism on the fuse holder secured by a barrel type lock to prevent tampering with the fuse holder. The power line to the fuse is attached to the fuse holder with, preferably, a spade tongue solderless connector. Duplex receptacles are preferably wired in circuit by mechanical means such as solderless eyelets. The preferred power cord is a three-wire cable, for example a 12-gauge SJOOW cable, having rubberized neoprene/thermoset or similar materials rubber like in construction, suitable for indoor use, with oil and water resistant outer jacket, and oil resistant inner conductors. The preferred power cord plug is a twist type locking molded plug, for example a NEMA type L5-20, 20 ampere, 125 volt, twist type locking molded plug; and, the power cord attaches to the power control housing with a strain, no strain, or no snag strain relief fitting, such as for example, a molded strain relief fitting. The device is connected to a master power distribution system that is commonly used to distribute temporary electricity to trade shows and other special events, and provide power to individual exhibitor sites or areas in accordance with predetermined agreements.

The device has the capability to prevent circuit breaks in the master power distribution system through limiting the amount of electricity users can exploit from the master power distribution system, thus preventing overloading of the master system and any resulting circuit break.

The power control and locking device described herein provides electricity to multiple exhibitors in limited, regulated quantities. In its normal use, it prevents exhibitors from utilizing electricity that was purchased by or allotted to another exhibitor.

Reference symbols or names are used in the Figures to indicate certain components, aspects or features shown therein. Reference symbols common to more than one Figure indicate like components, aspects or features shown therein.

DETAILED DESCRIPTION

Figure 1:
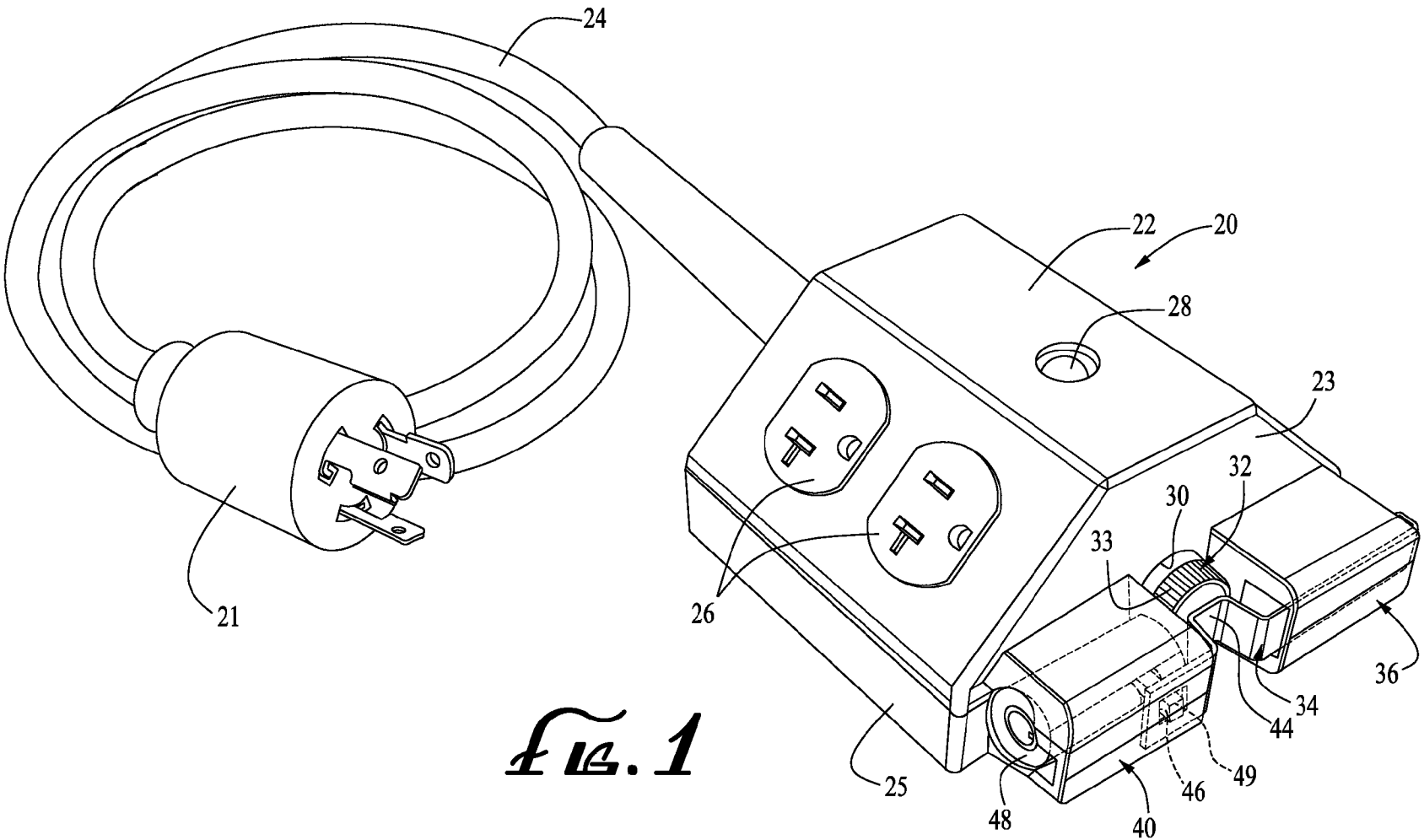
FIG. 1 is a perspective view of a preferred embodiment electrical power control and locking device including a power cord and in an unlocked position.
Figure 2:
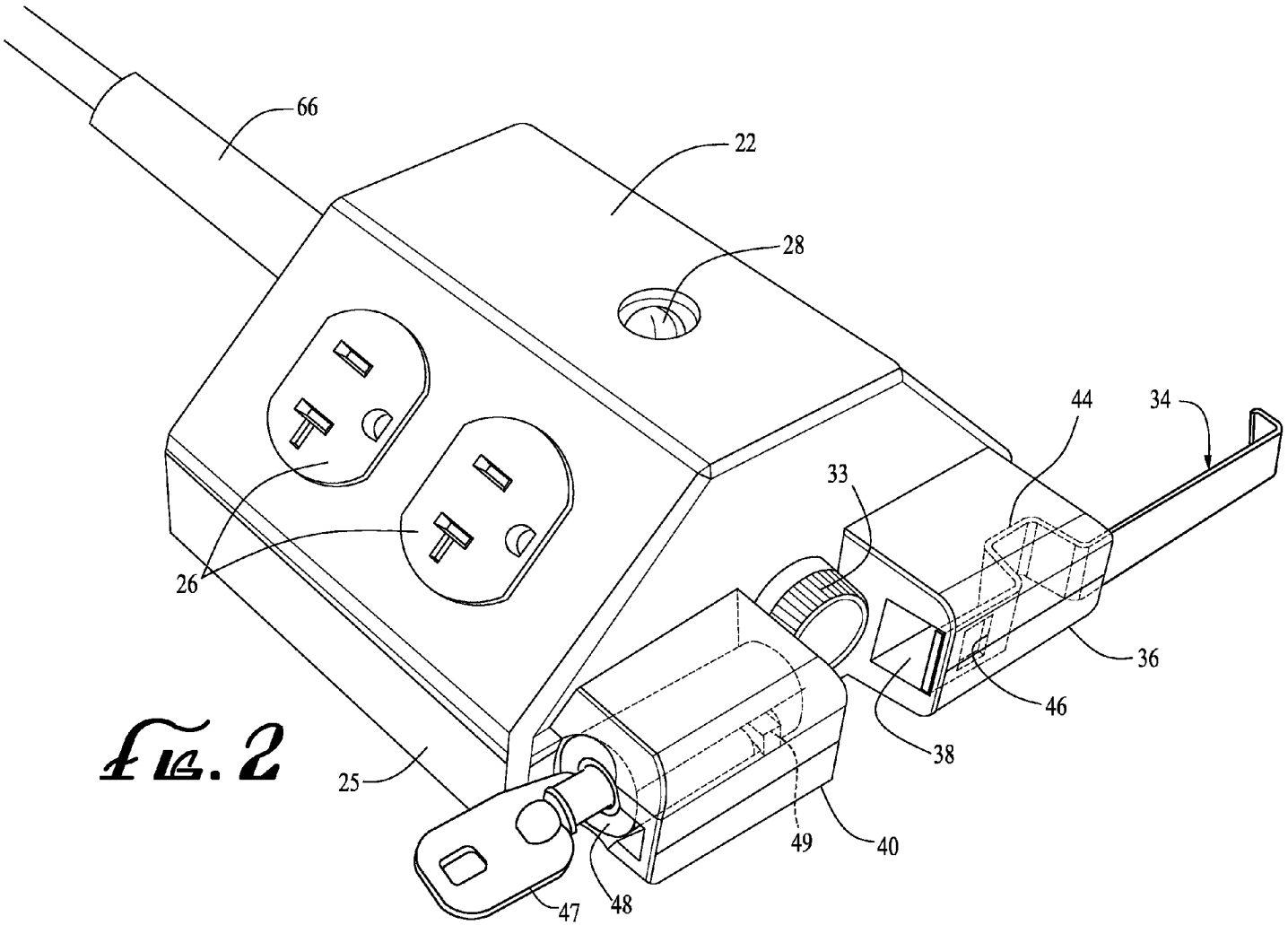
FIG. 2 is a perspective view of the FIG. 1 embodiment showing the lock in the unlocked position, the key and the power cord plug.

With reference to FIGS. 1 and 2 the exterior of a preferred embodiment of the present electrical power control circuit and locking device 20 will be described. The device 20 is a circuit box that preferably includes a housing 22, an electrical power cord 24, one or more power receptacles 26, such as an industrial grade, 20 ampere, nominal 115-125 VAC, NEMA 5-20 R configuration, duplex receptacle and a plug 21. The housing 22 is preferably of an electrical insulator material, such as a plastic that is durable. The presently most preferred material is a translucent polycarbonate that has been injection molded in the shape and configuration shown. Also, the housing is preferably of a 2-piece, molded construction, the pieces of which are preferably fastened together with a plurality of conventional fasteners, such as screws. In the embodiment shown in FIG. 1, the two pieces are screwed together with eight Philips type screws inserted into recesses provided in the backside or bottom part 25 of the 2-part housing.

The housing also preferably includes a light-emitting diode 28 (LED) semiconductor on the front, outer surface of the circuit box 20 that emits a continuous light when the electrical circuit is energized and ceases to emit light when a fuse breaks and/or electrical current is otherwise not available to the circuit, such as when the device is unplugged from a power supply. With reference to FIG. 1, the assembled housing is provided with an opening 30, preferably at the end opposite that of the power cord, and into which a fuse holder 32 is positioned. The preferred fuse holder is commercially available from Ferraz Shawmut as its GPM-S, 600 v, 30 A panel mount model. The fuse holder 32 accommodates conventional fuses, one of which is shown at 68, preferably with a 5, 10 or 20 amps, type G fuse.

Figure 3:
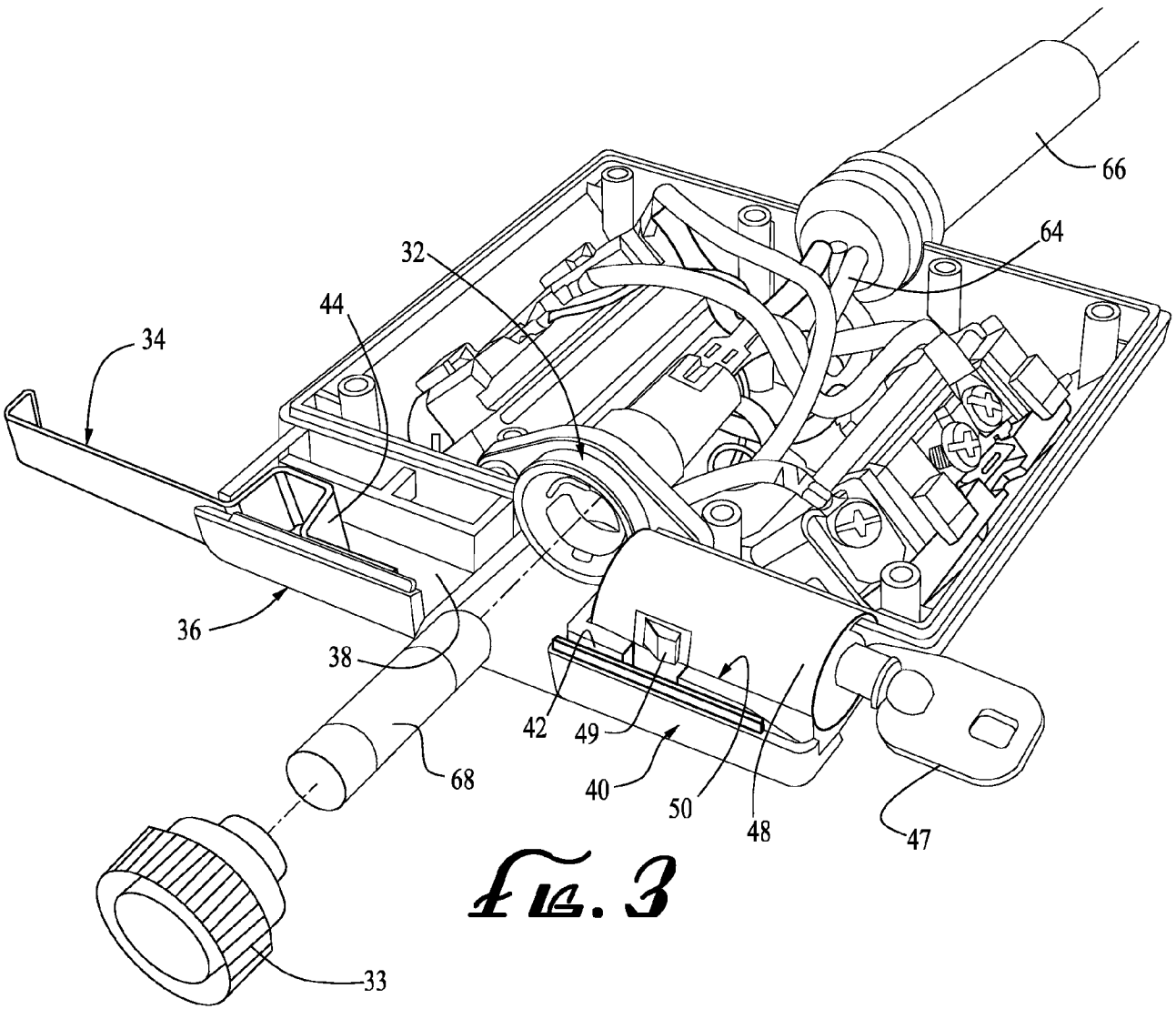
FIG. 3 is a bottom, partially disassembled view of the FIG. 1 embodiment showing the fuse holder and the locking bracket in the unlocked position.
Figure 4:
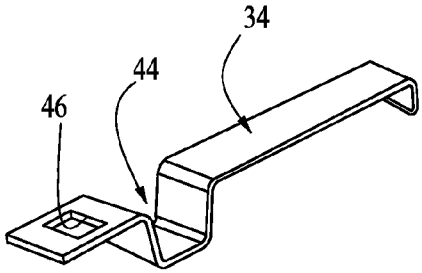
FIG. 4 is a perspective view of the locking bar of the FIG. 1 embodiment.

With reference to FIGS. 1-3, the box 20 is also provided with a locking mechanism that includes a locking bar 34, a first locking bar housing portion 36, a first locking bar housing portion recess 38, a second locking bar housing portion 40 and a second locking bar housing portion recess 42, all of which are preferably positioned on the housing 22 adjacent the fuse holder 32.

With reference to FIGS. 1-4, the locking bar or bracket 34 has length, width, and thickness that is sized to slide or reciprocate within the recesses 38 and 42. Bar 34 also has a U-shaped region or channel 44 and a hole or aperture 46. When in the locked position, the distal end or bottom of the U is pressed tightly against the top of the fuse holder 32, and prevents the fuse holder cap 33 from being rotated to open the fuse holder and remove and replace the fuse contained therein. The hole or aperture 46 is for receiving the plunger or striker of a lock that in turn prevents the locking bar from being removed from the recess(es) 38 and/or 42. As shown in FIG. 3, lock 48 is positioned within lock channel, or cavity 50 in the second locking bar housing portion 40. Preferably the lock is a barrel type, keyed lock having a single plunger or striker and a key 47. Other types of locks can be used in the present power control and locking device, so long as it functions for its intended purpose of preventing unauthorized removal and replacement of the fuse. In the locked position, the locking bar is inserted fully into the recesses, the bottom part of the U-shaped portion of the locking bar is pressed against the cover of the fuse holder, and the lock plunger or striker extends through the hole 46 to thereby prevent sliding of the locking bar, and prevent access to the fuse holder.

Figure 5:
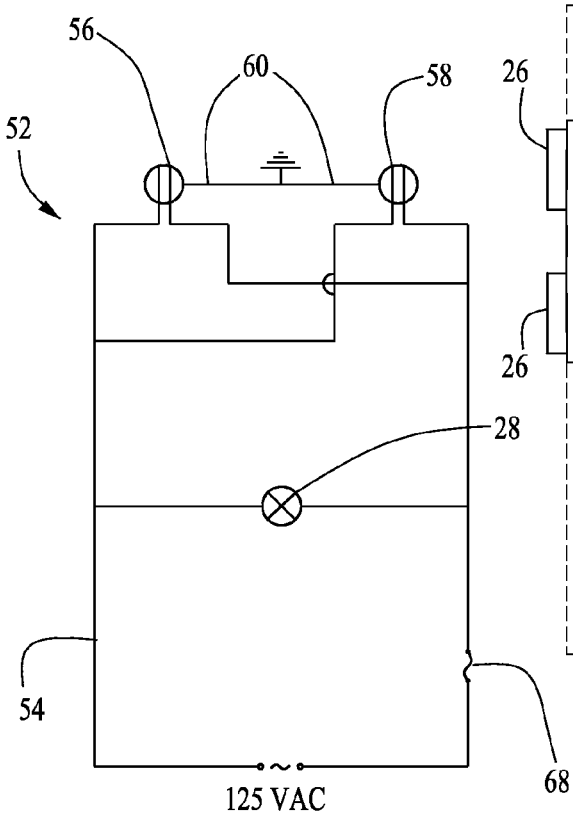
FIG. 5 is a diagram of the circuit of the FIG. 1 embodiment.
Figure 6:
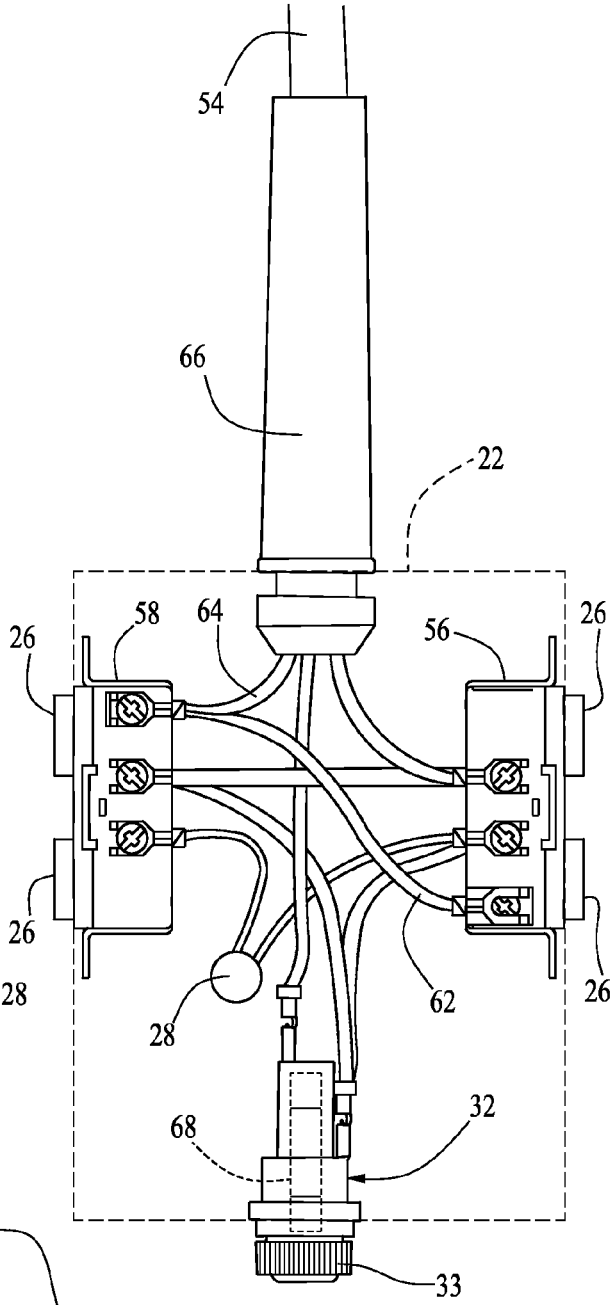
FIG. 6 is a view of the interior of the FIG. 1 embodiment showing the electrical connections of various components such as the outlets, wiring, fuse holder and power cord.

With reference to FIGS. 5-6 the electrical circuit 52 is provided with a source of nominal 125 VAC electrical power through line 54 to each of the two receptacles 56, 58, which are connected in parallel. The receptacles 56, 58 are also connected to ground via line 60 as shown in FIG. 5, and represented in FIG. 6 with wires 62 and 64. As shown in FIGS. 1, 5 and 6 power is supplied via the power cord 24, and the power line 54 is represented by wires shown connecting the receptacles 56 and 58, the fuse holder 32 and the LED 28. The fuse inside the fuse holder is shown as fuse 68 in FIGS. 5 and 6. The power cord is attached to the housing with a strain relief fitting 66. While one preferred embodiment is provided for a specific 125 VAC power distributions system, other embodiments that accommodate other voltages, and other currents may be constructed using the principles explained herein.

As may be seen from the above description, the locking mechanism prevents tampering with and unauthorized access to the fuse holder. Thus, when electrical loads are placed on the circuit in any single power box that exceeds the current limit for the installed fuse, the fuse will blow, and the host or other administrative authority will eventually become aware of the situation. In this way when an exhibitor uses his/her assigned electrical power box, or permits its use to exceed the amount of electrical power purchased from the convention center provider, the power will stop and the exhibitor will have to contact the convention center provider to remedy the situation.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

The invention claimed is:

1. A convention center trade show exhibitor electrical power control system comprising:

a master electrical power distribution system powered by a public or private electrical utility;

an electrical power control outlet electrically connected to the power distribution system and adapted to provide fused electrical power to the trade show exhibitor, the outlet comprising:

a housing made of an electrical insulator;

an electrical power receptacle positioned in the housing;

a fuse holder positioned in the housing, in electrical circuit with the electrical power receptacle and the electrical power distribution system, and having a cavity adapted to contain a fuse;

an electrical power availability indicator contained in the housing, in circuit with the electrical power receptacle and the electrical power distribution system, and adapted to indicate availability of electrical power to the electrical power receptacle; and, a lock having a locked position and an unlocked position, the locked position preventing access to the fuse holder but not the electrical power receptacle.

2. The power control system of claim 1 wherein the housing is made of a translucent polycarbonate.

3. The power control system of claim 1 wherein the electrical power receptacle is a 20 ampere, nominal 115-126 VAC, duplex receptacle.

4. The power control system of claim 1 wherein the fuse holder is a panel mount fuse holder adapted to hold a 5, 10 or 20 amp fuse.

5. The power control system of claim 1 wherein the electrical power availability indicator is a light emitting diode.

6. The power control system of claim 1 wherein the electrical power control outlet is connected to the power distribution system through a strain relief fitting.

7. The power control system of claim 1 wherein the system further includes a locking bar adapted for movement from the unlocked position to the locked position, and from the locked position to the unlocked position;

the housing further includes a cavity within which the locking bar is positioned; and, the housing further includes a cavity within which the lock is positioned.

8. The power control system of claim 1 further including:

a locking bar having a length, width and thickness;

the locking bar having a u-shaped region along its length;

the locking bar having an aperture along its length;

whereby the locking bar u-shaped region abuts the fuse holder and the locking bar aperture receives a plunger of the lock when the lock is in the locked position.

9. The power control system of claim 1 in which the lock is a single plunger, barrel lock.

10. The power control system of claim 1 wherein the fuse cavity is accessible through an opening in the housing and the locked position of the lock prevents access to the opening for the fuse cavity.

11. A method of providing electrical power to trade show exhibitors comprising:

providing a master electrical power distribution system;

providing an electrical power control outlet capable of electrical connection to the power distribution system and adapted to provide fused electrical power to a trade show exhibitor;

the outlet comprising:

a housing made of an electrical insulator;

an electrical power receptacle positioned in the housing;

a fuse holder positioned in the housing, in electrical circuit with the receptacle, having a cavity adapted to contain a fuse and having a cap adapted to cover the cavity;

an electrical power availability indicator contained in the housing, in circuit with the receptacle, and adapted to indicate the presence of electrical power to the receptacle;

the housing including a first recess that retains a single plunger, barrel lock;

the housing including a second recess that slidably retains a locking bar;

the locking bar having length, width and thickness;

the locking bar having a u-shaped region along its length;

the locking bar having an aperture along its length;

placing a fuse in the fuse holder cavity;

closing the fuse holder cap to cover the cavity with the fuse inside the cavity;

sliding the locking bar in the second recess to a position whereby the locking bar u-shaped region abuts the fuse holder cap;

operating a lock key to position the lock plunger in the locking bar aperture to lock the fuse in place in the fuse holder and to prevent access to the cavity;

removing the key from the lock; and, energizing the outlet by electrically connecting the outlet to the power distribution system.

* * * * *

UNITED STATES PATENT AND TRADEMARK OFFICE

CERTIFICATE OF CORRECTION

PATENT NO. : 7,791,864 B2
APPLICATION NO. : 12/027446
DATED : September 7, 2010
INVENTOR(S) : Raymond T. Matyas et al.

It is certified that error appears in the above-identified patent and that said Letters Patent is hereby corrected as shown below:

Title page, item (73), "Interface Group - Nevada, Inc., Las Vegas, NV (US)" should read --Interface Group - Nevada, Inc. d/b/a Sands Expo & Convention Center, Las Vegas, NV (US)--

Signed and Sealed this

Thirtieth Day of November, 2010

David J. Kappos

David J. Kappos
*Director of the United States Patent and Trademark Office*